United States Patent [19]

Fromentin

[11] Patent Number: 4,749,828

[45] Date of Patent: Jun. 7, 1988

[54] BIDIRECTIONAL ACCELEROMETRIC ISOLATOR

[75] Inventor: Jean Fromentin, Pessac, France

[73] Assignee: Commissariat a l'Energie Atomique, Paris, France

[21] Appl. No.: 900,786

[22] Filed: Aug. 27, 1986

[30] Foreign Application Priority Data

Aug. 27, 1985 [FR] France ..... 85 12782

[51] Int. Cl.[4] ..... H01H 35/14

[52] U.S. Cl. ..... 200/61.53

[58] Field of Search ..... 200/61.45 R, 61.53; 180/282; 340/669

[56] References Cited

U.S. PATENT DOCUMENTS

| | | | |
|---|---|---|---|
| 3,022,393 | 2/1962 | Weaver | 200/61.45 R |
| 3,096,411 | 7/1963 | Chabrek et al. | 200/61.53 |
| 3,859,650 | 1/1975 | Prachar | 200/61.53 X |
| 3,889,130 | 6/1975 | Breed | 200/61.53 X |
| 4,266,107 | 5/1981 | Abbin, Jr. et al. | 200/61.53 |
| 4,345,124 | 8/1982 | Abbin, Jr. et al. | 200/61.53 |
| 4,574,168 | 3/1986 | Devaney | 200/61.53 |

FOREIGN PATENT DOCUMENTS 2138288 1/1973 France .

*Primary Examiner*—J. R. Scott

*Attorney, Agent, or Firm*—Cesari and McKenna

[57] ABSTRACT

A bidirectional accelerometric isolator comprises a box, at least one pair of elelctric contact pins facing one another in the box and an arrangement for reversing the electrical continuity state of the pins in the box. This arrangement includes a first mass sensitive to an acceleration of the box in a first direction in order to move to an arming position in which the mass is automatically rendered integral by a lock with a second mass, the first and second joined masses then being sensitive to an acceleration of the box in a second direction which is opposite to the first so that they move into an actuating position reversing the electrical continuity state of said pins. The isloator has particular application to fields requiring the making or breaking of d.c. or pulse-type currents, particularly those of a very high level, following two successive accelerations of the isolator in opposite directions, such as in aerospace, robotics and particularly in constraining environments.

8 Claims, 1 Drawing Sheet

BIDIRECTIONAL ACCELEROMETRIC ISOLATOR

BACKGROUND OF THE INVENTION

The present invention relates to a bidirectional accelerometric isolator requiring two accelerations in opposite directions in order to be operative.

The invention applies to widely varying fields, such as aerospace, where an acceleration and a deceleration may result from a trajectory in the atmosphere, or robotics where machines use reciprocating movements. It can also apply to the security field, when it is necessary to make or break an electric contact, e.g. in the case of a mechanical traffic incident or accident (road, railway, air), as well as in constraining environments requiring the making or breaking of d.c. or pulse-type currents, particularly of a very high level.

SUMMARY OF THE INVENTION

The invention relates to a bidirectional accelerometric isolator making it possible to make or break one or more electric contacts following the application of two successive accelerations in opposite directions.

More specifically, the present invention relates to an accelerometric isolator, wherein it comprises a box, at least one pair of electrical contact pins facing each other inside said box and mechanical means for reversing the electrical continuity state between the said pins, said means comprising a first mass located in the box and sensitive to one acceleration of the box in a first direction for moving into an arming position in which it is automatically made integral, by locking means with a second mass located in the box, the first and second masses being joined by said locking means and being sensitive to an acceleration of the box in a second direction opposite to the first direction in order to move into an actuating position, the electrical continuity state between said pins being reversed by the displacement of the second mass into the actuating position.

According to an embodiment of the accelerometric isolator, the box comprises two end walls in which are mounted the electric pins which are insulated from said end walls. The first mass is normally biased toward one of the walls by first elastic means and the second mass is normally biased toward the other wall by second elastic means.

According to another embodiment of the accelerometric isolator, the second mass has a hole, e.g. a bore, on the axis of the pair of pins whose walls electrically contact said pins. Said walls are electrically insulated from the second mass.

According to another embodiment of the accelerometric isolator, the first mass surrounds the second mass and the locking means comprise at least one spring-loaded lug able to project radially from one of the masses to penetrate a groove formed in the other mass, when the first mass is in the arming position.

According to another embodiment of the accelerometric isolator, the groove has a sloping edge permitting an unlocking of the two masses.

According to a preferred embodiment of the accelerometric isolator, sliding means are located between the two masses. These sliding means are e.g. constituted by at least three balls or three rollers located in three circumferentially spaced grooves formed in one of the masses.

Advantageously, the box contains a fluid for damping the movements of the masses.

According to a constructional variant of the accelerometric isolator, the isolator comprises several pairs of parallel electric contact pins, the second mass having at the most one hole per pair of pins.

BRIEF DESCRIPTION OF THE DRAWINGS

The invention is described in greater detail hereinafter relative to non-limitative embodiments and the attached drawings, wherein show.

Figure 1:
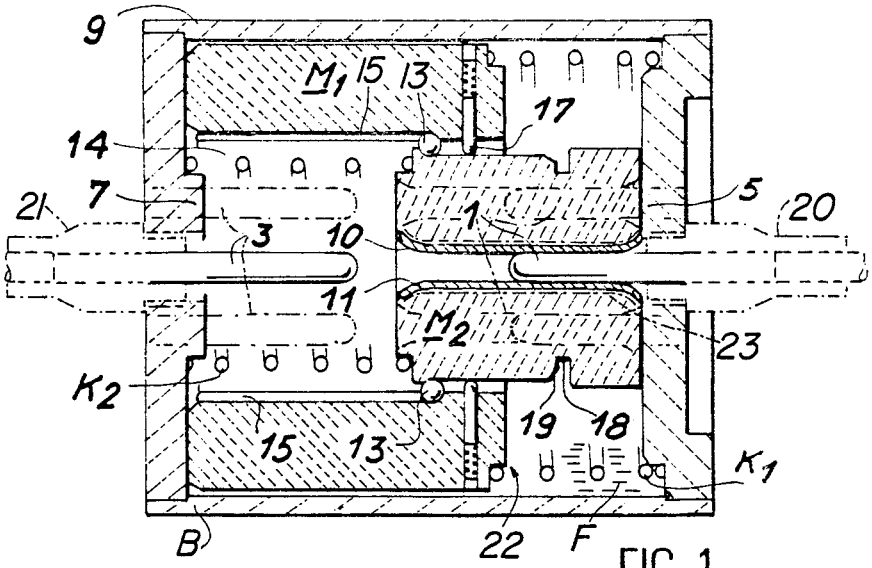
FIG. 1, diagrammatically and in longitudinal section, an embodiment of the bidirectional accelerometric isolator in the inoperative state according to the invention.

FIGS. *2a* and *2b*, diagrammatically, the bidirectional accelerometric isolator of FIG. 1 respectively when subject to a first acceleration in a first direction and when subject to a second acceleration in the reverse direction.

DETAILED DESCRIPTION OF THE PREFERRED EMBODIMENTS

The accelerometric isolator according to the invention, as shown in FIGS. 1 to *2b* comprises a box B constituted by two parallel, planar end walls 5, 7, connected by a cylindrical wall 9. Each of the end walls 5, 7 is traversed by one or several aligned electric contact pins 1, 3. Preferably, these pins 1, 3 are electrically insulated from walls 5, 7 by insulators shown in phantom at 20, 21, respectively, in FIG. 1. Continuous and dot-dash lines are used to indicate in FIG. 1 the cases where each wall is traversed by one and two pins 1,3, respectively. Pins 1, 3 are perpendicular to walls 5, 7 and therefore parallel to the axis of the box B. They project into the box toward each other and their ends outside the box can be connected to any appropriate electric circuit. Within the box are placed means shown generally at 22 in FIG. 1 for reversing the electrical continuity state between pins 1, 3.

These means 22 comprise a first annular mass $M_1$, biased toward wall 7 of the box B by a spring $K_1$ bearing on the opposite wall 5. The annular mass $M_1$ defines by its inner cylindrical surface a chamber 14. This annular mass $M_1$ is positioned coaxially within the box wall 9, its axis being parallel to pins 1, 3, so as to be able to move along said axis towards box wall 5.

The means 22 for reversing the electrical continuity state also comprise a second cylindrical mass $M_2$ biased toward the wall 5 of the box by a spring $K_2$ bearing on the opposite wall 7. Mass $M_2$ is positioned coaxially to mass $M_1$, so that it can slide within the latter in chamber 14. To this end, sliding means are located between the two masses $M_1$, $M_2$. These sliding means include at least three longitudinal grooves 15 on the inner cylindrical surface of mass $M_1$, in which are received rollers or balls 13 rolling on the outer cylindrical surface of mass $M_2$.

In the inoperative state, i.e. when springs $K_1$, $K_2$ are relaxed, the lengths of masses $M_1$, $M_2$ and of the box are such that the end of mass $M_2$ facing wall 7 is partly fitted into the end of the mass $M_1$ facing wall 5.

The second mass $M_2$ has a hole 10, e.g. constituted by a bore, extending along the axis of each pair of the opposing pins 1, 3, each hole extending between the end faces of the mass $M_2$ that are parallel to box walls 5, 7. Each pin of each pair of electric contact pins 1, 3 can slide into the hole 10 corresponding thereto during the reciprocating movements of mass $M_2$ in the direction of that pin. Furthermore, each hole 10 has conductive walls 11. When the two pins of the same pair are both within the hole 10 corresponding thereto, the conductive walls 11 of the latter make it possible to establish an electric contact between these two pins. Therefore, all or part of the walls 11 of each hole 10 is covered with a conductive material deposit in order to make it possible to electrically connect the two pins 1, 3 of a pair of pins by contact with said deposit. All the walls 11 are electrically insulated from mass $M_2$ either because the body that constitutes mass $M_2$ is composed of a non-conductive material or because there is an insulator around walls 11 as shown in phantom at 23 FIG. 1.

In the embodiment shown in FIG. 1, only pin 1 is located in hole 10 when mass $M_2$ is in its initial inactive position. Thus, there is no electric contact between pins 1, 3.

Locking means are provided between masses $M_1$ and $M_2$ to render them integral with one another during an acceleration that moves mass $M_1$ towards box wall 5. These means comprise at least one spring lug 17, located in a radial hole 18 extending from the inner surface of mass $M_1$, in the vicinity of its end closest to wall 5. The locking means also include an annular groove 18 formed on the outer surface of mass $M_2$, in the vicinity of its end closest to wall 5. Thus, when spring $K_1$ is compressed, each lug 17 is located in groove 18.

In order to permit a separation of masses $M_1$, $M_2$ following the actuation of the isolator, the edge 19 of groove 18 closest to wall 7 can be inclined to facilitate retraction of lug 17. The locking and unlocking of masses $M_1$, $M_2$ will be described in greater detail hereinafter relative to FIGS. 2*a* and 2*b*. It is obvious that any other means making it possible to keep masses $M_1$, $M_2$ attached and optionally to disengage them can be used in the isolator according to the invention.

The movements of masses $M_1$ and $M_2$ are damped, e.g. by the flow of a fluid F such as oil, between the walls of masses $M_1$ and $M_2$. When pins 1, 3 are in contact with walls 11 of the corresponding hole 10, they prevent the flow of fluid along that hole 10.

There follows now a description of the operation of the bidirectional accelerometric isolator according to the invention on the basis of a pair of electric contact pins 1, 3.

In the inactive state (FIG. 1), springs $K_1$, $K_2$ placed between masses $M_1$, $M_2$ and walls 5, 7 are relaxed. Depending upon the spring constants of springs $K_1$, $K_2$, masses $M_1$, $M_2$ are respectively in the vicinity of or against walls 7, 5, respectively.

Electrical pin 1 supported by the first wall 5 is then in electrical contact with walls 11 of the hole 10 corresponding thereto in mass $M_2$. On the other hand, pin 3 supported by the second wall 7 is not in contact with walls 11 of said hole 10.

Moreover, in this inactive state, there is no electrical contact between pins 1 and 3, i.e. the contact is said to be open.

Under the action of a first acceleration $\gamma_1$ (FIG. 2*a*) applied to the box B in a direction parallel to the axis defined by pins 1, 3 and in a direction extending from the first wall 5 to the second wall 7, mass $M_1$ moves towards wall 5 in a direction opposite the direction of acceleration $\gamma_1$ towards an arming position, so that mass $M_1$ compresses spring $K_1$. The magnitude of the acceleration $\gamma_1$ necessary to displace mass $M_1$ towards mass $M_2$ is a function, to within the frictional forces, of the value of mass $M_1$ and of the spring constant or stiffness of spring $K_1$. During acceleration $\gamma_1$, mass $M_2$ remains engaged against wall 5.

Moreover, due to the displacement of mass $M_1$ towards mass $M_2$, each lug 17 engages in groove 18 present in mass $M_2$, thus joining masses $M_1$ and $M_2$. Depending upon the positions of lugs 17 in the inner wall of mass $M_1$ and groove 18 in the outer wall of mass $M_2$, mass $M_1$ is locked at a greater or lesser distance from wall 5.

Figure 2A:
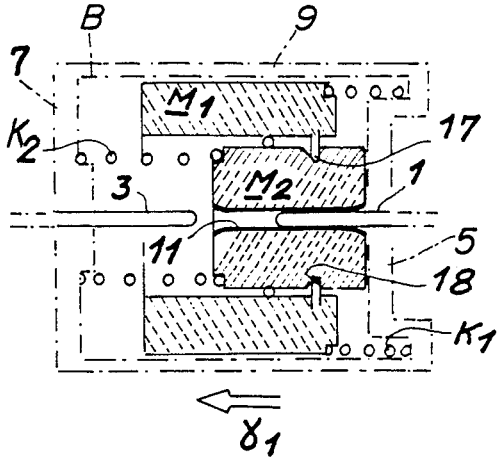

As shown in FIG. 2*a*, when the box B is subject to an acceleration $\gamma_1$, pins 1, 3 are still not in electrical contact because mass $M_2$ has not moved. That is, the end of pin 3 facing pin 1 remains free. This acceleration $\gamma_1$ only joins masses $M_1$ and $M_2$.

When a second acceleration $\gamma_2$ (FIG. 2*b*) is applied to the box B in a direction parallel to the axis of pins 1, 3 and in a direction extending from the second wall 7 to the first wall 5, i.e. in a direction which is opposite that of the first acceleration $\gamma_1$, masses $M_2$ and $M_1$ move together towards wall 7 into an actuating position. Thus, spring $K_2$ is compressed, while spring $K_1$ is relaxed. As masses $M_1$ and $M_2$ are joined together by lugs 17 in groove 18, when mass $M_1$ abuts against wall 7, it blocks the displacement of mass $M_2$. Any other relative position of the integral masses $M_1$, $M_2$ during acceleration $\gamma_2$ is possible. For example, for given positions of lugs 17 and/or grooves 18, mass $M_2$ can abut wall 7, thus limiting the displacement of mass $M_1$. In this case, a recess is made in wall 7 to receive spring $K_2$.

The movement of masses $M_1$, $M_2$ towards wall 7 takes place when acceleration $\gamma_2$ has a given magnitude, which is a function of masses $M_1$, $M_2$ and of the stiffness of springs $K_1$, $K_2$, bearing in mind the frictional forces in the isolator.

The displacement of mass $M_2$ to wall 7 enables the pin 3 to penetrate hole 10 and walls 11, while pin 1 is still in there. Thus, an electrical contact is established between pins 1, 3 via walls 11 of said hole 10, the contact then being said to be closed.

The length of the pins 1, 3 used makes it possible to determine the axial positions of lugs 17 and groove 18. Thus, lugs 17 and groove 18 are disposed in such a way that pin 3 penetrates hole 10 when mass $M_1$, which is integral with mass $M_2$, abuts wall 7.

By use of this isolator, a continuous or brief electrical contact can be established between electrical pins 1, 3 following two successive opposite accelerations $\gamma_1$, and $\gamma_2$.

A continuous contact is obtained, (1) when the acceleration $\gamma_2$ is maintained, keeping mass $M_1$ integral with mass $M_2$, or (2) following the stopping of the acceleration $\gamma_2$, i.e. in the inactive state, when masses $M_1$, $M_2$ are integral and when the stiffness of springs $K_1$, $K_2$, the value of masses $M_1$, $M_2$ and the lengths of pins 1, 3 make it possible to maintain an electrical contact between pins 1, 3 and walls 13 of hole 10, or by locking either mass $M_1$, or (3) mass $M_2$ to wall 7, masses $M_1$ and $M_2$ being integral.

A brief contact is obtained by unlocking masses $M_1$, $M_2$ following successive acceleration $\gamma_1$ and $\gamma_2$, i.e. after establishing the electrical contact. Therefore, unlocking means are associated with the isolator according to the invention.

Figure 2B:
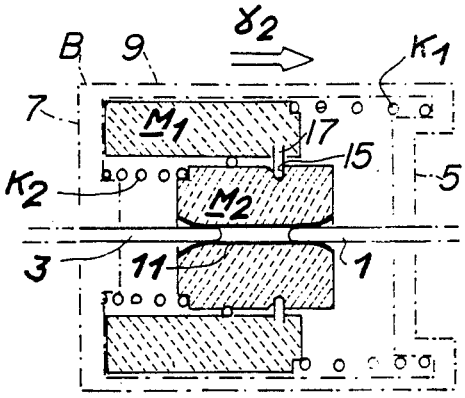

An example of the unlocking means is shown in FIGS. 1 to 2*b*. More particularly, groove 18 has an inclined edge 19, so that said groove 18 offers a larger opening on the outer wall of mass $M_2$. Thus, mass $M_1$ is integral with mass $M_2$ until the latter, as a result of the stiffness of its spring $K_2$, pushes back by means of its inclined edge 19 the lugs 17. The lugs 17 retract, releasing mass $M_2$ from mass $M_1$ and spring $K_2$ relaxes, moving mass $M_2$ toward wall 5. Now, pin 3 is no longer in electrical contact with walls 11 of the hole 10, so that the contact is again open. During further successive accelerations $\gamma_1$ and $\gamma_2$, the isolator can reestablish electrical contact between pins 1, 3.

This example is not limitative and other unlocking means can be envisaged, particularly by the use of an electromagnet, whose magnetic core forces back mass $M_2$ towards the first wall 5, following two successive accelerations $\gamma_1$ and $\gamma_2$.

In FIG. 1, three pairs of pins 1, 3 are shown, one pair by continuous lines and the two other pairs by dot-dash lines. The number of pairs of pins used depends on the use of the isolator according to the invention. The isolator can have between one and several pairs of pins arranged parallel to one another and at a spacing which is a function of their use.

FIG. 1 shows one hole 10 per pair of pins, but it is obvious that mass $M_2$ can have holes 10 which are common to several pairs of pins located in the same plane, as a function of the use of the isolator.

Masses $M_1$ and $M_2$ are preferably cylindrical, but other shapes, and in particular parallelepipedic shapes, can be envisaged. Each of the masses $M_1$, $M_2$ can also be constituted by several masses which are assembled together and in particular two masses, the spacing between said two masses respectively forming chamber 14 and hole 10. Furthermore, several springs $K_1$, $K_2$ can be used in the isolator according to the invention.

In addition, box wall 9 can completely or partly surround the means for reversing the electrical continuity state between the pins. Moreover, locking means for masses $M_1$, $M_2$ different from those described in FIGS. 1 to 2*b* can be envisaged without passing beyond the scope of the invention.

The above description has been given with reference to an embodiment of the isolator according to the invention with open contact in the inactive state and closed contact after two successive accelerations $\gamma_1$ and $\gamma_2$, but the reverse is also possible. Thus, by modifying the lengths of pins 1 and 3, the isolator can be in closed contact in the inactive state and in open contact following two successive accelerations $\gamma_1$ and $\gamma_2$. For this purpose, use is made of a longer pin 3 and a shorter pin 1 than in the embodiment described relative to FIGS. 1 to 2*b*, so that pins 1 and 3 are in contact with walls 11 of hole 10 in the inactive state and pin 1 is no longer in contact with walls 11 of said hole 10 after two successive accelerations $\gamma_1$, $\gamma_2$. In the same way, with this type of isolator, it is possible to obtain a continuous or brief contact.

The isolator according to the invention can have reduced overall dimensions with a diameter of approximately 30 mm and a length of approximately 70 mm. It is normally able to operate under thermal conditions ranging between approximately −25° C. and +70° C., in a mechanical environment with static accelerations and white noise. However, it is insensitive to "aggressions", so that it does not function in an accidental environment, such as one with a high shock level and fires.

The isolator according to the invention makes it possible to establish between two electric pins, respectively in the case of a continuous or brief contact, a d.c. current of approximately 10 A or a pulse-type current of approximately 3000 A for 2 μs under a voltage between 0 and 4 kV.

The two successive acceleration $\gamma_1$ and $\gamma_2$ of opposite directions respectively correspond both to an acceleration followed by a deceleration and to a deceleration followed by an acceleration.

The isolator according to the invention has very wide-ranging applications, appropriate calculations of the value of the masses, the stiffness of the springs and the lengths of the electric pins making it possible to adapt the isolator to a given problem, even in a constraining environment.

What is claimed is:

1. An accelometric isolator comprising

A. an enclosure having an axis;

B. at least one pair of contact means supported within said enclosure at locations spaced apart along said axis;

C. a pair of masses positioned in said enclosure for movements from respective inactive positions therein in opposite directions along said axis in response to oppositely directed accelerations of said enclosure parallel to said axis;

D. coacting locking means on said masses for locking said masses together when said masses assume a selected relative position within said enclosure during acceleration of said enclosure parallel to said axis in one direction; and E. electrically conductive means on one of said masses which changes the electrical conductivity state between said contact means when the locked-together masses are moved in said one direction during an acceleration of said enclosure parallel to said axis in the opposite direction.

2. The isolator defined in claim 1 and further including means for biasing said masses toward their respective inactive positions.

3. The isolator defined in claim 1 wherein

A. said enclosure includes end walls spaced apart at opposite ends of said axis;

B. each pair of electrically isolated contact means comprise conductive pins mounted to said end walls and extending toward one another parallel to said axis; and C. said one of said masses has an axial passage which slidably receives each pair of pins, said passage having an electrically conductive surface which constitutes said conductive means.

4. The isolator defined in claim 1 wherein

A. said other of said masses is an annular body that receives said one of said masses; and B. said locking means include 1. at least one spring-loaded lug projecting from one mass toward the other mass, and at least one lug-receiving means in the other mass which receive said at least one lug when said masses have said selected relative position in said enclosure.

5. The isolator defined in claim 4

A. further including means for biasing at least one of said masses toward its inactive position; and B. wherein one of said at least one lug and receiving means has an inclined edge to facilitate unlocking of said masses by said biasing means when said enclosure is not being accelerated.

6. The isolator defined in claim 1

A. wherein said masses have opposing surfaces which extend parallel to said axis; and B. further including bearing means between said opposing surfaces to facilitate relative motion of said surfaces.

7. The isolator defined in claim 1

A. wherein said enclosure is substantially fluid tight; and

B. further including a fluid in said enclosure for damping movements of said masses within said enclosure.

8. The isolator defined in claim 1 wherein

A. said enclosure supports several pairs of contact means, each such pair comprising a pair of collinear pins projecting toward one another parallel to said axis; and B. said other of said masses has an axial passage aligned with each pair of pins for slidably receiving same, each said passage having an electrically conductive surface that constitutes said conductive means.

* * * * *